US005181590A

United States Patent [19]

Carpenter et al.

[11] Patent Number: 5,181,590

[45] Date of Patent: Jan. 26, 1993

[54] LUGGAGE FRAME WITH PULL HANDLE

[75] Inventors: Lester E. Carpenter, Middletown; Wayne I. Schmitt, Coventry, both of R.I.; Laurence Snell, Attleboro, Mass.; David Bieber, East Greenwich; Donald W. Stucke, Warren, both of R.I.; Jeremy S. Waltzer, Attleboro, Mass.

[73] Assignee: American Tourister, Inc., Batesville, Ind.

[21] Appl. No.: 669,382

[22] Filed: Mar. 14, 1991

Related U.S. Application Data

[63] Continuation-in-part of Ser. No. 487,459, Mar. 2, 1990, Pat. No. 5,048,649.

[51] Int. Cl.[5] ..... A45C 5/14; A45C 13/04; A45C 13/22

[52] U.S. Cl. ..... 190/18 A; 190/24; 190/115; 190/127

[58] Field of Search ..... 190/18 A, 119, 120, 190/122, 127, 115, 24, 107

[56] References Cited

U.S. PATENT DOCUMENTS

| | | | |
|---|---|---|---|
| 56,482 | 7/1866 | Wolff | 190/18 A |
| 86,742 | 2/1869 | Fishbeck | 190/122 |
| 177,751 | 5/1876 | Ringwalt | 190/24 |
| 1,019,547 | 3/1912 | Spiro | 190/127 |
| 1,710,041 | 4/1929 | Brandt | 190/122 |
| 2,002,836 | 5/1935 | Rossi | 190/18 A X |
| 2,250,126 | 7/1941 | Cross | 190/107 |
| 2,392,926 | 1/1946 | Kelly | 190/18 A X |
| 2,437,029 | 3/1948 | Howard | 280/DIG. 3 X |
| 2,510,754 | 6/1950 | Norlin | 190/18 A |
| 2,581,417 | 1/1952 | Jones | 190/18 A X |
| 2,718,943 | 9/1955 | Braverman | 190/107 |
| 2,728,426 | 12/1955 | Dobyns | 190/107 |
| 2,806,563 | 9/1957 | Einhorn | 190/107 |
| 3,522,955 | 8/1970 | Warner, Jr. | 190/18 A X |
| 3,526,921 | 9/1970 | Aupke | 190/18 A X |
| 3,592,314 | 7/1971 | Jacobson | 190/122 X |
| 3,606,372 | 9/1971 | Browning | 190/18 A X |
| 3,655,215 | 4/1972 | Becklin | 190/18 A X |
| 3,763,973 | 10/1973 | Taylor | 190/127 X |
| 3,799,568 | 3/1974 | Hager | 280/37 |
| 3,917,038 | 11/1975 | Foge et al. | 190/18 A |
| 3,989,128 | 11/1976 | Walker | 190/18 A |
| 3,997,038 | 12/1976 | Walker | 190/18 A |

(List continued on next page.)

FOREIGN PATENT DOCUMENTS

| | | | |
|---|---|---|---|
| 550901 | 12/1959 | Belgium | 190/122 |
| 0106906 | 5/1984 | European Pat. Off. | 190/18 A |
| 336802 | 10/1989 | European Pat. Off. | 190/18 A |
| 3302672 | 8/1984 | Fed. Rep. of Germany | 190/18 A |
| 3636064 | 4/1988 | Fed. Rep. of Germany | 190/18 A |
| 821263 | 8/1937 | France | 190/18 A |
| 899995 | 9/1944 | France | 190/18 |
| 59346 | 5/1954 | France | 190/18 A |
| 1485732 | 6/1967 | France | 190/18 R |
| 487220 | 11/1953 | Italy | 190/18 A |
| 20732 | of 1910 | United Kingdom | 190/122 |

*Primary Examiner*—Sue A. Weaver
*Attorney, Agent, or Firm*—Wood, Herron & Evans

[57] ABSTRACT

A frame for luggage includes a plywood floor, a channel-shaped main frame attached to the ends of the floor and projecting therefrom, a pair of A-frame brackets capturing the ends of the floor at their bases and being attached at their apexes to the main frame, a pair of major wheels rotatably mounted on transverse axles fixed to the floor centered longitudinally between the ends of the floor, and a caster wheel mounted to said floor at the each end thereof. The luggage frame is strong, yet lightweight and is supported primarily on the major wheels which being on fixed axles maintain the luggage frame tracking in the direction in which it is pulled while the castered wheels provide low friction ground support for the ends of the floor.

20 Claims, 3 Drawing Sheets

U.S. PATENT DOCUMENTS

| | | | |
|---|---|---|---|
| 4,062,429 | 12/1977 | Tabor et al. | 190/18 A |
| 4,244,452 | 1/1981 | Seynhaeve | 190/18 A |
| 4,299,313 | 11/1981 | Null | 190/18 A |
| 4,358,005 | 11/1982 | Fontana | 190/18 A |
| 4,358,006 | 11/1982 | Castelli | 190/18 A |
| 4,411,343 | 10/1983 | Cassimally et al. | 190/18 A |
| 4,418,804 | 12/1983 | Bradley et al. | 190/127 X |
| 4,433,760 | 2/1984 | Pelavin | 190/127 X |
| 4,508,202 | 4/1985 | Siegert et al. | 190/115 |
| 4,538,709 | 9/1985 | Williams et al. | 190/18 A |
| 4,561,526 | 12/1985 | Winter et al. | 190/115 |
| 4,618,035 | 10/1986 | Mao | 190/18 A |
| 4,707,881 | 11/1987 | Van Hoye | 16/44 |
| 4,759,431 | 7/1988 | King et al. | 190/18 A |
| 4,771,871 | 9/1988 | Lambracht | 190/1 |
| 4,792,025 | 12/1988 | Thomas | 190/18 A |
| 4,838,396 | 6/1989 | Krenzel | 190/18 A |
| 4,852,705 | 8/1989 | Cowan, Jr. | 190/18 A |
| 5,048,649 | 9/1991 | Carpenter et al. | 190/115 X |

LUGGAGE FRAME WITH PULL HANDLE

CROSS-REFERENCE TO RELATED APPLICATIONS

This application is a continuation-in-part of co-pending application Ser. No. 487,459, entitled "Luggage with Pull Handle," filed Mar. 2, 1990, now U.S. Pat. No. 5,048,649, and assigned to the assignee of this invention.

BACKGROUND OF THE INVENTION

This invention relates to a luggage frame with pull handle and, more particularly, to a luggage frame for use in the construction of luggage of the type where the user pulls the luggage by a handle and the luggage rolls on wheels along the ground thereby relieving the user of physically carrying heavily loaded luggage.

In the above-referenced patent application, an improved wheel and pull handle structure for luggage is described that provides improved control and tracking of the luggage when pulled by a pull handle on wheels. This improved luggage structure includes a pair of larger diameter wheels centrally located on the bottom of the luggage preferably in wheel wells recessed into the luggage side walls and a smaller diameter end wheel at each end of the luggage. The luggage rolls primarily on the larger diameter wheels with the end wheels providing low friction ground support for the forward and rearward ends of the luggage.

Preferably, but not necessarily, the smaller diameter end wheels are above the larger diameter side wheels when the bottom wall of the luggage is horizontal. With this wheel arrangement, the luggage can be rolled with a three-wheel support or it can, for maneuverability, be spun on a central axis simply by revolving about the two major wheels with the minor wheels not touching the ground. Maneuverability of pull type luggage is vastly improved over prior wheel systems.

The luggage further included a rigid handle at one end which could be extended from the luggage and tilted forward to permit the luggage to be pulled by the user. When the user released the handle, it automatically returned to a vertical position.

In adapting this luggage construction to softside luggage, special problems are encountered. As one example, the wheel arrangement described above puts additional stresses on the luggage bottom wall, including torsional stress causing racking of the bottom wall. In hardside luggage, the structural rigidity of the luggage side and end walls contributes to the overall rigidity of the luggage including the luggage frame. However, with softside luggage, that structural rigidity is not present.

Further, softside luggage must be relatively lightweight. Accordingly, the luggage frame must not only provide the needed strength and rigidity but also be lightweight.

SUMMARY OF THE INVENTION

Accordingly, it has been among the principal objects of this invention to provide an improved luggage frame for use in constructing luggage which may be pulled on major wheels by the user in accordance with the above description. This invention is particularly useful in making softside luggage although it could be adapted to hardside luggage as well.

In a presently preferred embodiment of the invention, a relatively lightweight but strong and rigid luggage frame is provided comprising a rigid floor, a channel-shaped main frame fixed with respect to the floor and projecting therefrom, and a pair of A-frame brackets, each attached at its base to an end of the floor and at its apex to the main frame.

A pair of major or larger diameters wheels are rotatably mounted on transverse axles fixed to the frame floor with the wheels projecting below the floor and being centered longitudinally between the ends of the floor preferably at the outboard edges. Smaller diameter caster wheels are mounted to the floor adjacent the ends thereof generally on the longitudinal axis of the floor and project below the floor. Preferably, the floor is prestressed in an arcuate configuration whereby the ends of the floor are above the center of the floor such that in normal use, the caster wheels are raised off the ground and the luggage frame is supported by the two major wheels.

An extendable and retractable pull handle is provided at one end of the main frame. The pull handle is rectangular in configuration and may be formed of a molded plastic. The handle slides in a pull handle slide fixed to the main frame. A flat spring is attached to the lower end of the pull handle. On extension of the pull handle in a vertical direction, the lower handle end slides into a spring clip. As the pull handle is rotated forwardly to a desired angle of inclination for pulling of the luggage, the flat spring becomes loaded. Accordingly, on release of the handle by the user, the spring force returns the handle to a vertically upright position whereupon it may be telescoped back inside of the luggage or used in the extended vertical condition to inch the luggage forward on its wheels.

The luggage frame is in turn enveloped in soft, flexible material such as fabric to form the softside luggage. As stated above, such softside luggage provides special problems in achieving a combination of good structural rigidity and light weight. To this end, the combination of the rigid prestressed floor, the A-frames attached at the ends of the rigid floor and to the main frame, and the main frame which is in turn fixed with respect to the rigid floor provide structural rigidity. Preferably, all of the frame parts are made of plastic, e.g., a thermo-plastic or thermoset material, whereby the luggage frame is relatively lightweight. In use, the luggage may be pulled by the handle on the major wheels whereby the user is not required to lift what may be heavily loaded luggage. The major wheels are affixed on axles which are in turn fixed to the floor of the frame construction and maintain the luggage frame tracking in the direction in which it is pulled while the minor caster wheels provide low friction ground support for the forward and rearward ends of the luggage.

DETAILED DESCRIPTION OF THE INVENTION

Figure 1:
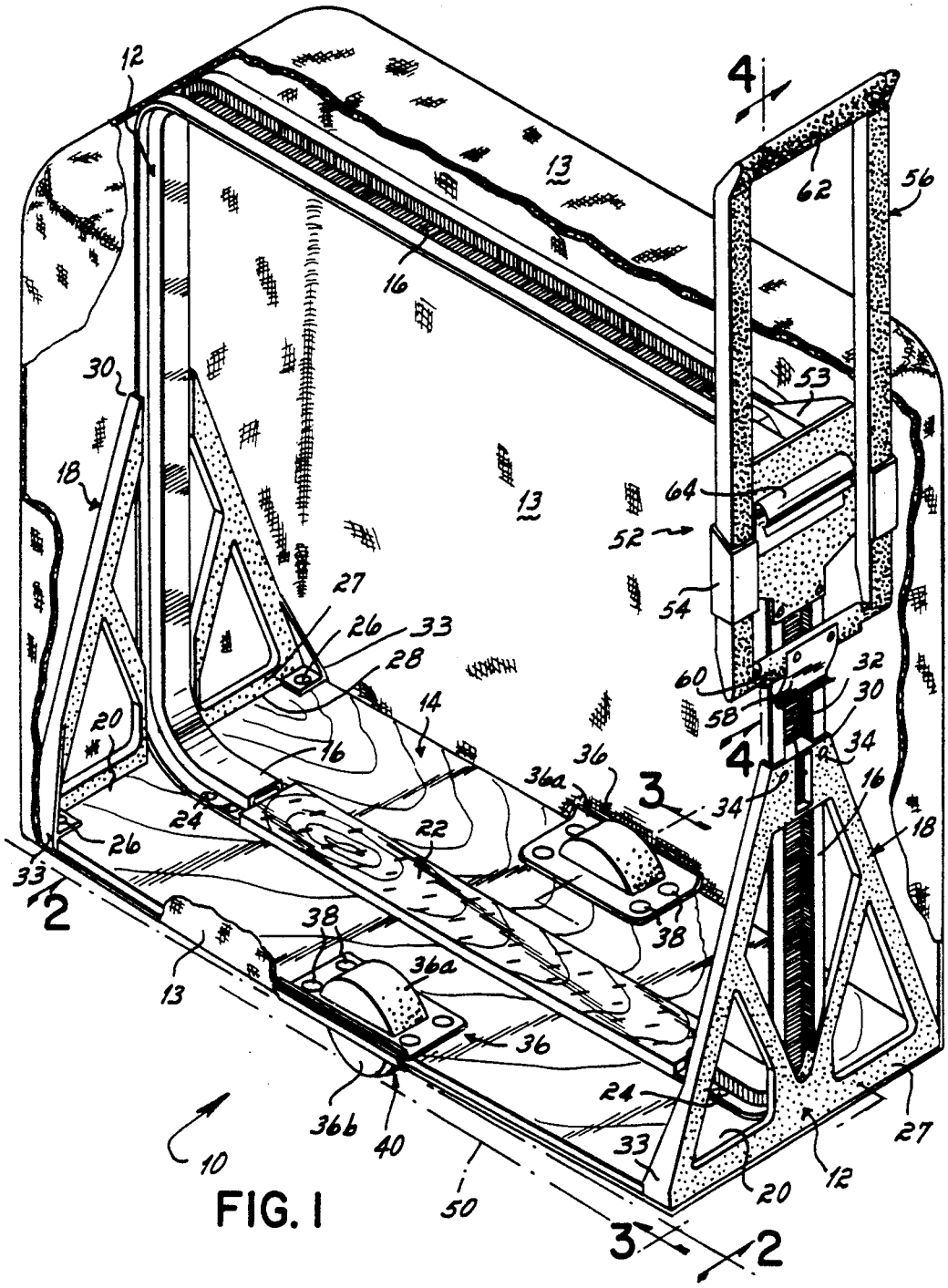
FIG. 1 is a perspective view with parts broken away of a piece of softside luggage showing the luggage frame assembly.

Referring now to FIG. 1, a presently preferred form of a softside embodiment of luggage is indicated at 10. This luggage includes a luggage frame 12 which is enveloped by flexible fabric-like material 13 to form the luggage enclosure. The frame 12 includes a floor 14, a main frame 16, and a pair of A-frame brackets 18 attached at the ends 20 of the floor 14 The floor 14 may be formed of plywood which is a light, strong, and relative inexpensive material in accordance with the two-fold objective of manufacturing both a rigid and lightweight luggage frame 12. As described in more detail below, the floor 14 is prestressed to an arcuate configuration whereby in use the ends of the floor are raised with respect to the center thereof. A central plywood brace 22 approximately two inches wide is glued and stapled longitudinally to the prestressed plywood floor to fix the desired curvature. Prestressing of the floor provides it with increased rigidity against end to end loads and, as described below, provides the desired "rocking" action in the finished assembly.

The main frame 16 is attached by rivets 24 to the floor 14 adjacent its ends 20 and projects therefrom. The main frame is of a channel-shaped configuration formed of an extruded plastic. The A-frame brackets 18 are likewise secured to the ends 20 of the floor 14 by rivets 26. The A-frame bracket is a molded plastic to provide a high strength, low weight assembly.

Figure 3:
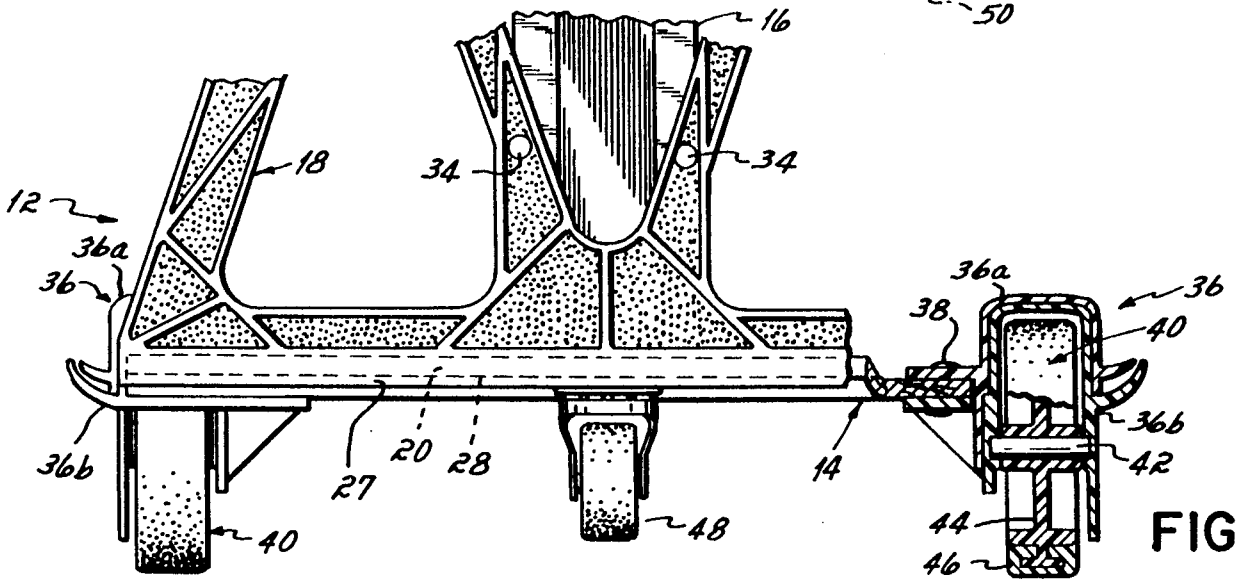
FIG. 3 is a partial cross-sectional view taken along line 3—3 of FIG. 1.

Referring in particular to FIG. 3, each A-frame bracket 18 includes at its base 27 a slot 28 which captures an end 20 of the floor 14 therein. The apex 30 (FIG. 1) of each A-frame bracket 18 includes a molded projection 32 which extends into the main frame channel 16 rivet 34 fix the A-frame bracket 18 with respect to the main frame 16. Lower flanges 33 molded in the bracket 18 extend around the edges of the floor 14 and also sandwich the floor 14 therebetween. Rivets 26 pass through the flanges 33 to secure the A-frame bracket 18 to the main frame 16. This construction provides excellent resistance to racking of the frame floor 14 as well as fixes the frame floor 14 in the overall assembly.

As further illustrated by FIG. 3, the A-frame bracket may be molded with a web configuration to reduce the amount of material used while maintaining strength and rigidity.

The plywood floor 14 includes a die cut relief which receives a two-part molded plastic wheel cup 36 secured to the floor 14 by rivets 38. The two-part molded wheel cup includes an upper **36*a* and lower 36*b* cup which sandwich the floor 14 between them (FIG. 3). Major wheels 40 are mounted on a fixed axles 42 secured to the wheel cups 36 in a direction transverse to the long axis of the floor 14. The wheels 40 include a plastic core 44 which is over-molded with a thermoplastic wheel 46** having a suitable hardness for rolling.

Figure 2:
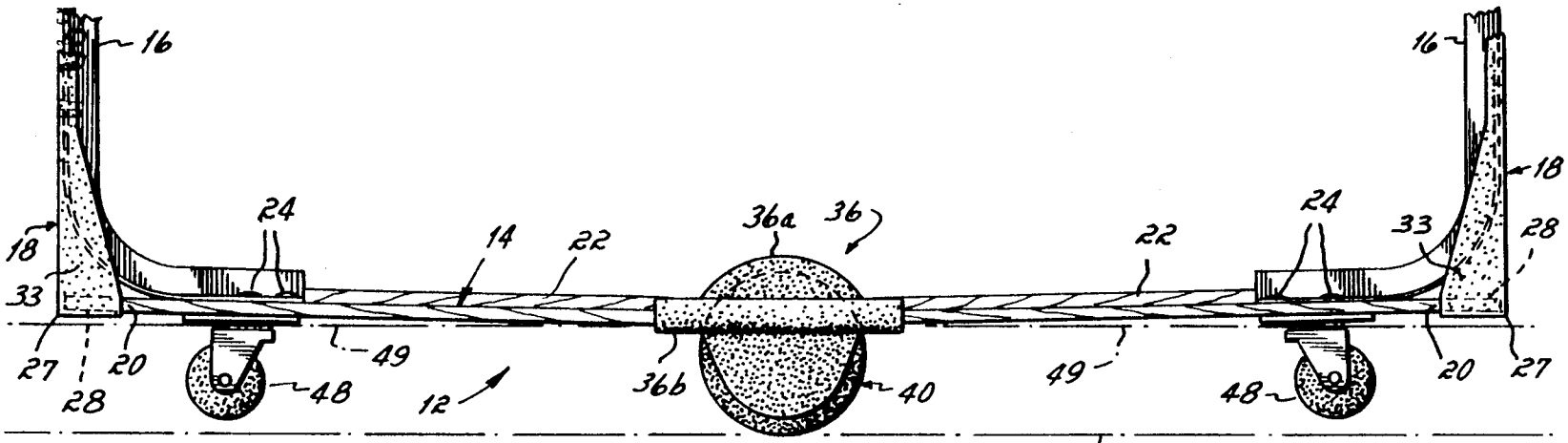
FIG. 2 is a view taken along line 2—2 of FIG. 1.

Referring now to FIG. 2, caster wheels 48 of a diameter smaller than the diameter of the major wheels 40 are attached to the underside of the floor 14 at the ends 20 thereof. As described above, the floor 14 is prestressed in an arcuate configuration such that the ends 20 are raised with respect to the center (as may be seen from the reference line 49). As shown in FIG. 2, this results in the luggage frame 12 being supported on a rolling surface 50 by the major wheels 40 along a transverse centerline of the floor 14 with the caster wheels 48 being off of the rolling surface 50. As such, the luggage 10 tracks primarily on the fixed major wheels 40. This provides improved tracking stability as well as the ability to easily rotate the luggage 10 on the major wheels 40. The luggage 10 "rocks" forward and backward on the major wheels 40, and the caster wheels 48 provide a low friction ground support for the ends to prevent the ends of the luggage from dragging on the ground as the luggage is pulled.

Figures 4, 4A, 4B:
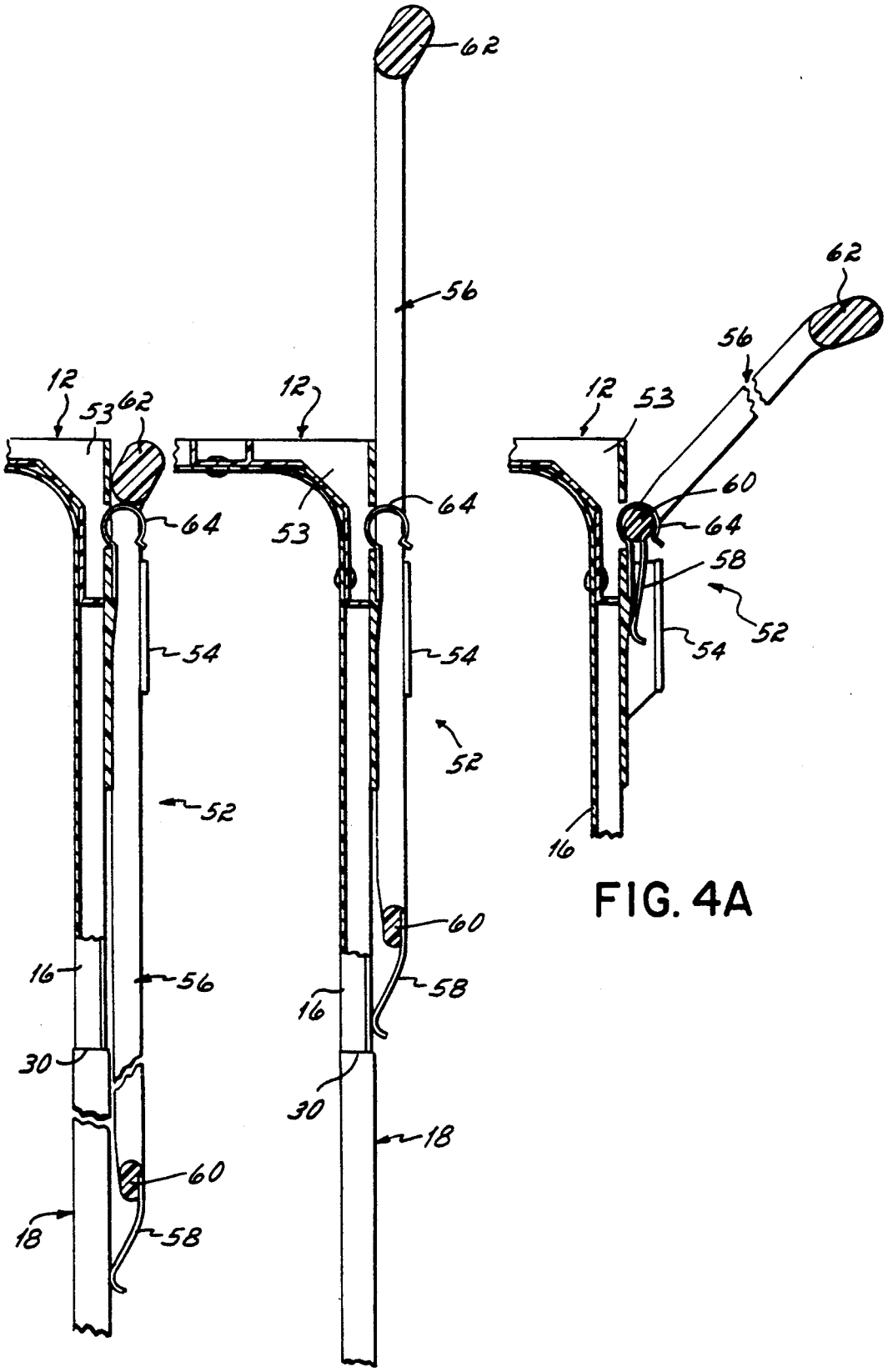
FIGS. 4, 4A, and 4B are cross-sectional views taken along line 4—4 of FIG. 1 illustrating the handle assembly, FIG. 4A being an extended position and FIG. 4B being a retracted position.

Referring back to FIG. 1, and in addition to FIGS. 4, 4A, and 4B, a pull handle assembly 52 is provided at one end of the luggage frame 12. The pull handle assembly 52 includes a pull handle slide 54 which is fixed to the main frame 12 by a triangular-shaped bracket 53, a molded plastic rectangular pull handle 56 which slides in the pull handle slide 54 in a vertical direction, and a flat spring 58 attached to an oblong-shaped transverse bar 60 of the pull handle 56. The pull handle 56 has a transverse hand grip 62 at its upper end. The pull handle slide 54 includes a spring clip 64 which receives and holds the oblong transverse bar 60 when the pull handle 56 is extended from the luggage (FIG. 4A). As may be seen more clearly with reference to FIGS. 4 and 4A, when it is desired to roll the luggage 10, the pull handle hand grip 62 is grasped by the user and the pull handle 56 is extracted from the luggage 10 by the user pulling upwardly (the retracted position of the handle 56 being shown in FIG. 4B). The handle 56 slides upwardly (FIG. 4) into the pull handle slide 54 until the oblong transverse bar 60 lodges in the spring clip 64 (FIG. 4A). The user then rotates the handle 56 to a desired angle of inclination for pulling the luggage on the major wheels 40. As such, when the luggage is being pulled with the handle 56 at an angle of inclination other than vertical, the transverse bar 60 will not dislodge from the spring clip 64 under a torsional load.

When the handle 56 is rotated to an angle other than vertical, the flat spring 58 which is riveted to the transverse bar 60 is spring loaded against the pull handle slide 54. Thus, when the user releases the handle 56, the flat spring 58 causes the handle 56 to rotate back to its vertical position. In this position, the handle can remain extended so that the user can inch the luggage forward slowly if desired or is in a position such that it may be slidably retracted within the luggage 10.

As previously stated, the luggage frame of this invention provides a relatively rigid, light-weight frame mounted on a pair of centrally located fixed major wheels particularly useful in the manufacture of softside luggage. However, the luggage frame could likewise be adapted for use in making hardside luggage as well. Further, a variety of materials are available out of which the frame may be constructed including relatively high strength extruded and molded plastics. Still further, the luggage frame of this invention is useful in constructing conventional luggage with-or without wheels.

Thus having described the invention, what is claimed is:

1. A luggage frame comprising a floor including a pair of ends and side edges extending therebetween;

a main frame including means for fixing to the floor and being constructed and disposed such that it projects from said floor;

a pair of frame brackets, each frame bracket including means for attaching its base to an end of the floor and to said main frame at a position spaced from the floor;

a pair of major wheels rotatably mounted on transverse axles, said axles including means for fixing to said floor, said wheels projecting below said floor and being centered on the side edges of said floor generally longitudinally between said ends of said floor; and elongated means at one end of the main frame for pulling said luggage frame primarily on said major wheels, said major wheels being on fixed axles maintaining the luggage frame tracking in the direction it is pulled.

2. The luggage frame of claim 1 wherein said main frame is an extruded channel which is attached to the ends of said floor.

3. The luggage frame of claim 1 wherein said floor is formed in an upwardly arcuate configuration such that in use the ends of the floor are raised from the ground with respect to the transverse centerline of the floor.

4. The luggage frame of claim 3 wherein said floor is formed of prestressed plywood.

5. The luggage frame of claim 1 wherein said means for fixing each said transverse axle is a wheel cup, said wheel cup including inner and outer members sandwiching said floor therebetween.

6. The luggage frame of claim 1 wherein each said frame bracket is an A-frame configuration including means forming a slot at its base into which the end of said floor fits, said A-frame further including flanges at the base angles thereof which extend around the side edges of said floor, said base of said A-frame being secured to said floor at said flanges.

7. The luggage frame of claim 6 wherein the main frame includes a channel and said A-frame includes at its apex a projection which is dimensioned to extend into said channel to fix the apex of said A-frame bracket with respect to said main frame.

8. The luggage frame of claim 1 wherein the said elongated means for pulling includes a pull handle assembly, said pull handle assembly including a pull handle slide attached to said main frame, a pull handle in said pull handle slide, said pull handle including means for sliding between an extended position and a retracted position, a spring including means for mounting to said pull handle, and a spring clip including means for mounting to said main frame for receiving said pull handle in the extended position of said pull handle.

9. The luggage frame of claim 8 wherein said pull handle is rectangular in configuration and includes a transverse hand grip at one end and an oblong-shaped transverse bar at the opposite end, said spring being a flat spring and being fixed to said transverse bar, said transverse bar being received in said spring clip in said extended position of said pull handle whereby said handle may be rotated to a desired angle of inclination by a user, said flat spring including means for returning said pull handle to a vertical position when said pull handle is released by the user.

10. A luggage frame comprising a floor having a pair of ends and side edges extending therebetween;

a channel-shaped main frame including means for attaching to said floor and being constructed and disposed such that it projects from the floor;

a pair of A-frame brackets, each Â-frame bracket including flanges at its base angles which extend around the side edges of said floor and including means for attaching at its base to an end of said floor and means forming a projection at its apex extending into said channel-shaped main frame, each said A-frame bracket including means forming a slot at its base into which an end of said floor extends and is captured therein;

a pair of major wheels rotatably mounted on transverse axles, said axles including means for fixing to said floor, said wheels projecting below said floor and being centered on the side edges of said floor generally longitudinally between said ends of said floor;

a pair of minor wheels mounted to said floor and projecting below said floor, each minor wheel being disposed adjacent one of said ends thereof;

a pull handle assembly mounted to one end of said main frame comprising a pull handle slide, a pull handle including means for sliding in said pull handle slide between a retracted and an extended position, said pull handle being a rectangle including a transverse hand grip at one end and an oblong-shaped transverse bar at the other end, a flat spring secured to said oblong-shaped transverse bar, and a spring clip including means for securing to said pull handle slide for receiving said oblong-shaped transverse bar in the handle extended position, said pull handle being rotatable in said spring clip whereby said pull handle may be disposed at a desired angle of inclination for pulling of the luggage frame, said flat spring including means for returning said pull handle to a vertical position when released.

11. The luggage frame of the claim 10 wherein said floor is plywood prestressed to an upwardly arcuate configuration wherein in use the ends of the floor are raised with respect to the transverse centerline of the floor, said frame further comprising a central plywood brace extending longitudinally along said floor and secured thereto to maintain said floor in its arcuate configuration.

12. A luggage frame comprising a floor having a length and width and including a pair of ends and side edges extending therebetween;

a main frame including means for fixing with respect to the floor and being disposed and constructed such that it projects from the floor, said main frame being an extruded channel which is attached to the ends of said floor; and a pair of end brackets, each end bracket having a base extending substantially the width of said floor at each end of said floor and including means for attaching at its base to an end of the floor and to said main frame at a position spaced from the floor, each said end bracket being constructed and disposed such that it projects from the floor.

13. The luggage frame of claim 12 wherein said floor is formed in an upwardly arcuate configuration such that in use the ends of the floor are raised from the ground with respect to the transverse centerline of the floor.

14. The luggage frame of claim 13 wherein said floor is formed of prestressed plywood.

15. The luggage frame of claim 12 wherein each said end bracket is an A-frame configuration and the means for attaching said bracket includes a slot at its base into which the end of said floor fits, said A-frame further including flanges at the base angles thereof which extend around the side edges of said floor, said base of said A-frame being secured to said floor at said flanges.

16. The luggage frame of claim 15 wherein the main frame includes a channel and said A-frame wherein the main frame includes a channel and said A-frame includes at its apex a projection which is dimensioned to extend into said channel to fix the apex of said A-frame bracket with respect to said main frame.

17. A luggage frame pull handle assembly comprising a pull handle slide, a pull handle in said pull handle slide, said pull handle including means for sliding between an extended position and a retracted position, a spring mounted to said pull handle, and a spring clip including means for fixing to said pull handle slide for receiving said pull handle in the extended position of said pull handle, said pull handle being rotatable in said spring clip to a desired angle of inclination, said spring bearing against said pull handle slide operative to return said pull handle to a vertical position when said pull handle is released.

18. The luggage frame of claim 17 wherein said pull handle is rectangular in configuration and includes a transverse hand grip at one end and an oblong-shaped transverse bar at the opposite end, said spring being a flat spring and being fixed to said transverse bar, said transverse bar being received in said spring clip in said extended position of said pull handle whereby said handle may be rotated to a desired angle of inclination by a user, said flat spring including means for returning said pull handle to a vertical position when said pull handle is released by the user.

19. A luggage frame comprising a floor having a pair of ends and side edges extending therebetween;

a channel-shaped main frame including means for attaching to said floor and being disposed and constructed to project from said floor; and a pair of A-frame brackets, each A-frame bracket including flanges at its base angles which extend around the side edges of said floor and being attached at its base to an end of said floor and including a projection at its apex being dimensioned for extension into said channel-shaped main frame, each said A-frame bracket including means forming a slot at its base into which an end of said floor extends and is captured therein.

20. The luggage frame of the claim 19 wherein said floor is plywood prestressed to an upwardly arcuate configuration wherein in use the ends of the floor are raised with respect to the transverse centerline of the floor, said frame further comprising a central plywood brace extending longitudinally along said floor and secured thereto to maintain said floor in its arcuate configuration.

* * * * *

UNITED STATES PATENT AND TRADEMARK OFFICE

CERTIFICATE OF CORRECTION

PATENT NO. : 5,181,590

DATED : January 26, 1993

INVENTOR(S) : Carpenter et al

It is certified that error appears in the above-identified patent and that said Letters Patent is hereby corrected as shown below:

Column 6, lines 67-68, delete "wherein the main frame includes a channel and said A-frame".

Signed and Sealed this

Eighth Day of March, 1994

Bruce Lehman

*Attest:*

BRUCE LEHMAN

*Attesting Officer*

*Commissioner of Patents and Trademarks*